US005832761A

United States Patent [19]

Chen

[11] Patent Number: 5,832,761

[45] Date of Patent: Nov. 10, 1998

[54] KEY IN COMBINATION WITH A TIMER AND EMITTER

[75] Inventor: Michael Chen, Taipei Hsien, Taiwan

[73] Assignee: Advance Security Inc., Taipei Hsien, Taiwan

[21] Appl. No.: 984,647

[22] Filed: Dec. 3, 1997

[51] Int. Cl.[6] ..... E05B 19/04

[52] U.S. Cl. ..... 70/395; 70/408

[58] Field of Search ..... 70/257, 278, 395, 70/408, 456 R

[56] References Cited

U.S. PATENT DOCUMENTS

| | | | |
|---|---|---|---|
| 3,640,108 | 2/1972 | Cairns | 70/456 R |
| 4,276,582 | 6/1981 | Burnett | 70/456 R X |
| 4,888,970 | 12/1989 | Kinzler et al. | 70/408 X |
| 4,901,548 | 2/1990 | Deslandes | 70/408 |
| 4,922,736 | 5/1990 | Tanaka et al. | 70/408 X |
| 5,181,927 | 1/1993 | Song | 70/456 R X |
| 5,309,743 | 5/1994 | Kokubu et al. | 70/257 |
| 5,730,013 | 3/1998 | Huang | 70/395 |

FOREIGN PATENT DOCUMENTS

| | | | |
|---|---|---|---|
| 481545 | 3/1938 | United Kingdom | 70/408 |

*Primary Examiner*—Lloyd A. Gall
*Attorney, Agent, or Firm*—Bacon & Thomas, PLLC

[57] ABSTRACT

A key, a timer and a signal emitter are integrally produced as one single item. The key with a timer and an emitter can facilitate a person to carry these items in one piece and make the use of the same with readiness.

1 Claim, 2 Drawing Sheets

KEY IN COMBINATION WITH A TIMER AND EMITTER

BACKGROUND OF THE INVENTION

The present invention relates to a key in combination with a timer and a signal emitter. The key with a timer and an emitter can facilitate a person to carry these items in one piece and make the use of the same with readiness.

In general, conventional timer, signal emitter for a remote controller and a key are separately kept and used individually for only one purpose. A person has to bring all these items with him or her along to serve the different purposes, making the carrying of the same a burden to the person.

Some people will bunch the keys and signal emitters together, that will make the bunch heavy in weight and bulky in size and cause inconvenience in carrying the same.

SUMMARY OF THE INVENTION

Therefore, the primary object of the present invention is to provide a key in combination with a timer and a signal emitter which is equipped with a easy-to-replace battery. The PC board of the signal emitter is housed in the body of a key having an upper removable cover. A number of control buttons are disposed on one side of the key body with a timer secured thereto also.

DETAILED DESCRIPTION OF THE PREFERRED EMBODIMENT

Figure 1:
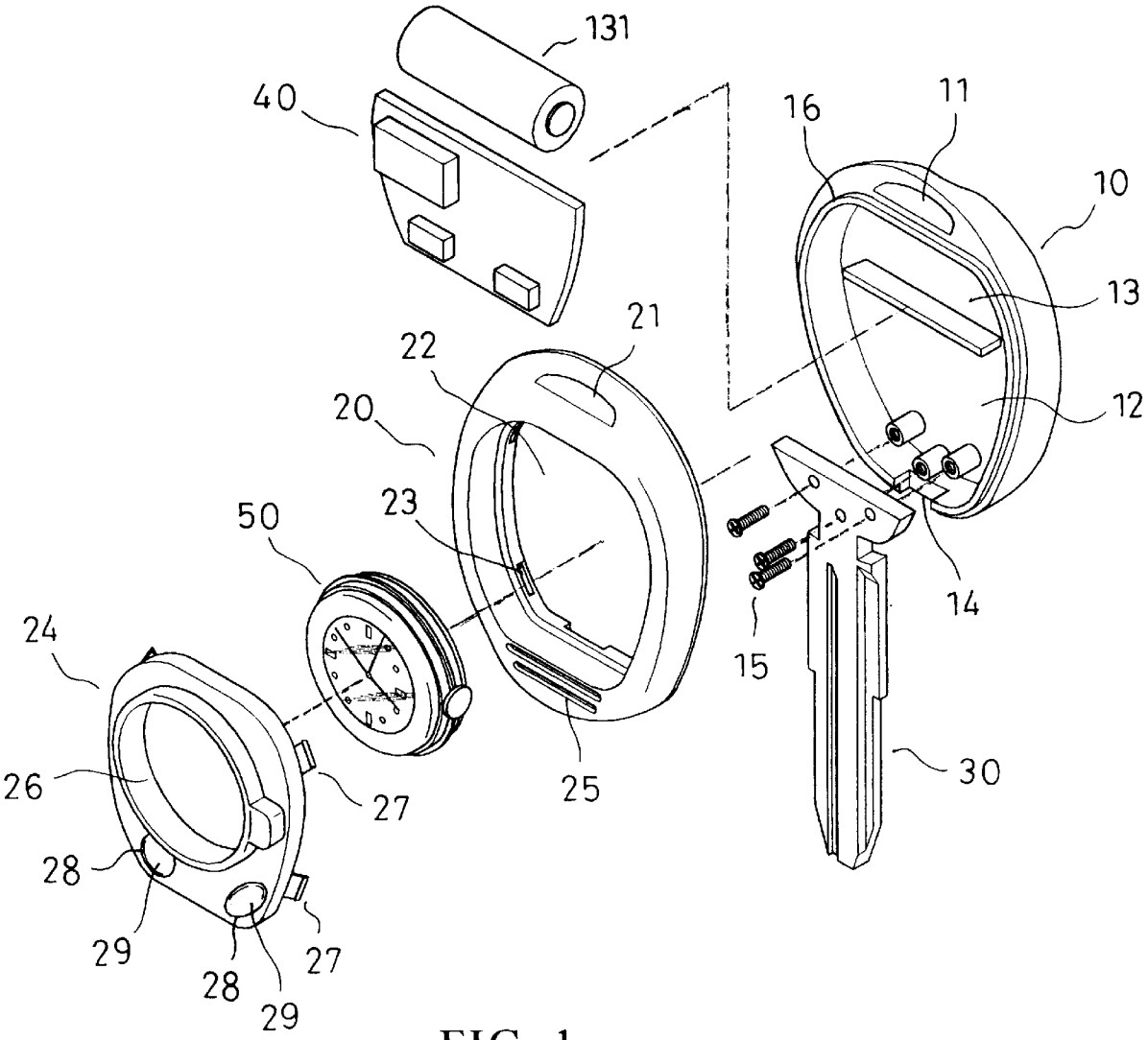
FIG. 1 is a perspective diagram showing the exploded components of the present invention.
Figure 2:
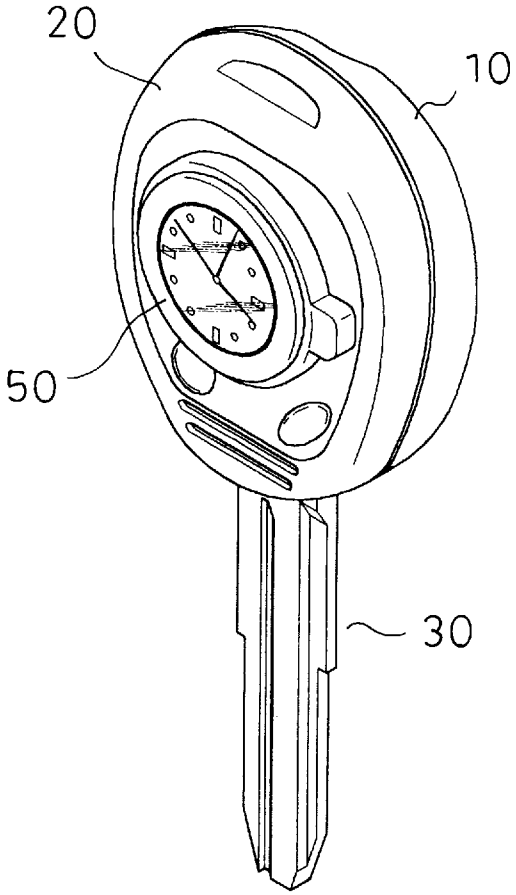
FIG. 2 is a diagram showing the assembly of the present invention.

Referring to FIGS. 1, 2, the key in combination with a timer and signal emitter of the present invention is mainly comprised of a casing 10, an upper cover 20, a key stem 30, a PC board 40 and a timer 50.

The casing 10 is of an oval shape and has a through hole 11 near the top edge thereof for the attachment of a key ring ( not shown ). A receiving cavity 12 is defined in the casing 10 for the location of the PC board 40 which is capable of performing remote control function. At the top of the receiving cavity 12 is disposed a battery room 13 for housing a battery 131. At the bottom of the receiving cavity 12 is provided with a recess 14 for the retaining of a neck portion 301 of the key stem 30 which is secured to the casing 10 by a number of screws 15. On the periphery of the casing 10 is provided a flanged protrusion 16 for the retaining engagement of the upper cover 20.

The upper cover 20 is also provided with a through hole 21 in conformance to the through hole 11 of the casing 10 with a large central opening 22 defined thereon. There are a number of retaining cavities 23 defined on the peripheral wall of the central opening 22 with which a lid 24 is engaged in assembly. At the bottom of the upper cover 20 is provided a pair of parallel slots 25. At the central portion of the lid 24 is provided a round opening 26 for the installation of a timer 50. On the outer periphery of the lid 24 in conformance to the retaining cavities 23 are disposed a number of projected hooks 27 which are engaged with the retaining cavities 23 in assembly so as to permit the lid 24 and the upper cover 20 to be integrally combined together. There are two oval holes 28 defined at the bottom of the lid 24 for housing two buttons 29 respectively whereby the assembly of the key, timer and the emitter can be integrally combined.

In practical use, a person has only to carry the multifunctional assembly of the timer, emitter and key 30 along. The person can use the key 30 to open a vehicle's door and use the emitter to turn on or off the security system of the vehicle. Besides, the timer 50 enables a person to tell the time with readiness.

It can be clearly seen that the present invention puts a key, timer and an emitter together so as to facilitate people to carry all the items in a single piece, making the keeping, carrying and using of these items in a more convenient manner.

I claim:

1. A key in combination with a timer and signal emitter, comprising: a casing, an upper cover, a key stem, a PC board and a timer being characterized by that:

said casing having a through hole near the top edge thereof for attachment of a key ring; a receiving cavity being defined in said casing for the location of said PC board capable of performing remote control function; at the top of said receiving cavity being disposed a battery room for housing a battery; at the bottom of said receiving cavity being provided with a recess for the retaining of a neck portion of said key stem secured to said casing by screws; on the periphery of said casing being provided with a flanged protrusion for the retaining engagement with said upper cover;

said upper cover being also provided with a through hole in conformance to said through hole of said casing with a large central opening defined thereon; a number of retaining cavities being defined on the peripheral wall of said central opening with which a lid being engaged in assembly; at the bottom of said upper cover being provided with a pair of parallel slots; at the central portion of said lid being provided with a round opening for the installation of said timer; on the outer periphery of said lid in conformance to said retaining cavities being disposed a number of projected hooks engaged with said retaining cavities in assembly so as to permit said lid and said upper cover to be integrally combined together; oval holes being defined at the bottom of said lid for housing buttons respectively whereby the assembly of the key, timer and the emitter can be integrally combined.

* * * * *